US005968707A

United States Patent [19]

Shinohara

[11] Patent Number: 5,968,707

[45] **Date of Patent: *Oct. 19, 1999**

[54] TRANSFER MATERIAL FOR USE IN THERMAL TRANSFER AND METHOD OF FORMING THERMAL TRANSFER IMAGES

[75] Inventor: Satoru Shinohara, Miyagi, Japan

[73] Assignee: Sony Corporation, Tokyo, Japan

[ * ] Notice: This patent is subject to a terminal disclaimer.

[21] Appl. No.: 09/115,047

[22] Filed: Jul. 14, 1998

Related U.S. Application Data

[63] Continuation of application No. 08/745,736, Nov. 12, 1996, Pat. No. 5,851,720.

[30] Foreign Application Priority Data

| | | | |
|---|---|---|---|
| Nov. 4, 1995 | [JP] | Japan | 7-320983 |
| Nov. 14, 1995 | [JP] | Japan | 7-320982 |
| Nov. 14, 1995 | [JP] | Japan | 7-320984 |

[51] Int. Cl.[6] ..... G03C 1/40; G03C 1/35; G03C 11/18

[52] U.S. Cl. ..... 430/201; 430/200; 430/220; 430/227; 430/232; 430/233; 430/248; 430/370; 430/510; 430/517; 430/504; 430/965; 347/105; 503/227

[58] Field of Search ..... 430/200, 201, 430/220, 227, 232, 231, 233, 370, 510, 965, 517, 504, 248; 347/105; 503/227

[56] References Cited

U.S. PATENT DOCUMENTS

| | | | |
|---|---|---|---|
| 1,102,878 | 7/1914 | Cocanari | 430/510 |
| 4,965,240 | 10/1990 | Imoto | 430/201 |
| 5,156,938 | 10/1992 | Foley et al. | 430/201 |
| 5,340,692 | 8/1994 | Vermuelen et al. | 430/965 |
| 5,401,620 | 3/1995 | Sasaki et al. | 430/510 |
| 5,480,767 | 1/1996 | Tosaka et al. | 430/510 |
| 5,589,316 | 12/1996 | Vanmaele | 430/201 |
| 5,593,803 | 1/1997 | Kim et al. | 430/201 |
| 5,851,720 | 12/1998 | Shinohara | 430/200 |

*Primary Examiner*—Richard L. Schilling
*Attorney, Agent, or Firm*—Hill & Simpson

[57] ABSTRACT

A transfer material colored to a predetermined color is used when images are formed on a transfer material for use in thermal transfer comprising a substrate and a dye receiving layer by a thermal transfer process.

When images are formed by an optional image forming method such as silver salt photographic process, ink jet process or thermal transfer process, a transfer material having sepia tone is used in each of the image forming processes thereby forming sepia tone images. Images having unique appearance can be formed easily upon forming images by a thermal transfer process. Images of sepia tone can be formed safely and conveniently.

17 Claims, 5 Drawing Sheets

TRANSFER MATERIAL FOR USE IN THERMAL TRANSFER AND METHOD OF FORMING THERMAL TRANSFER IMAGES

This is a continuation of application Ser. No. 08/745,736, filed on Nov. 12, 1996 now U.S. Pat. No. 5,851,720.

BACKGROUND OF THE INVENTION

1. Field of the Invention

The present invention concerns a transfer material for use in thermal transfer which is useful for forming transfer images of a desired tone, as well as a method of forming thermal transfer images of a desired tone by using the transfer material.

The present invention further relates to a method of forming images of sepia tone by laminating a laminate film colored to the sepia tone over images formed on a hard copy by an optional method, thereby obtaining a hard copy of the sepia tone.

2. Description of Related Art

An image forming method by thermal transfer process of heating an ink ribbon by a thermal head of the like in accordance with image information, transferring a dye from the ink ribbon to a material undergoing image transfer material such as a sheet of photographic paper (hereinafter referred to as a transfer material) by means of heat melting or thermal diffusion and forming images on the transferred material has been adopted generally. In particular, an image forming method by a subliming thermal transfer process for forming thermal transfer images by using an ink ribbon having an ink layer comprising a subliming or heat diffusing dye has been noted in recent years as a method of preparing a hard copy of video images since full color photographic images of a continuous gradation can be formed.

By the way, transfer materials used for forming images in the thermal transfer process have been formed so as to exhibit a white color. This is because better color reproducibility can be provided to images as an output sheet of a hard copy. If the transfer material exhibits a color other than white, full color or black and white photographic-images can not be formed at a good color reproducibility.

On the other hand, it has also been desired to provide images with various refined appearance in recent years. For example, since photographs discolored to a sepia tone provides a feeling of elapse of long years, sepia tone photographs have been prepared artificially by applying a special treatment to silver salt photographic paper and displayed and sold then in theme parks such as Western village. Further, in a case of forming sepia tone images by the thermal transfer process, the tones of images outputted to a printer are adjusted to the sepia tone by using soft wares in the printer or soft wares of a host computer to a digital printer. That is, in a video printer, since input signals are usually video signals such as NTSC composite, S-Video or RGB composite signals, it is difficult to convert image data into those of the sepia tone. Then, the outputted images are converted into the sepia tone by changing the soft wares in the printer and providing a print density curve used exclusively for the sepia tone. Further, in a digital printer, images on the connected host computer are previously converted into the sepia tone by the soft wares of the host computer and then the data are transferred to the printer.

However, among the existent methods for forming sepia tone images, a method of preparing the sepia tone photographs by applying a special treatment to a silver salt photographic paper involves a problem with respect to the toxicity of a solution for the treatment or the post-treating method.

Further, a method of forming sepia tone images by the thermal transfer or ink jet process, by softwares in the printer or soft wares of the host computer for the digital printer involves a problem that replacement of soft wares is difficult between a case of forming images of usual tones and a case of forming images of the sepia tone.

SUMMARY OF THE INVENTION

In view of the foregoing problems, it is an object of the present invention to enable to easily prepare hard copies of a unique apparatus not attainable so far, with no restriction to the sepia tone.

The present inventors have accomplished the present invention based on the finding, beyond the traditional concept, that images having a unique appearance can be formed easily, in attaining faithful color reproducibility by coloring a transfer material for use in the formation of images by a silver salt photographic process, ink jet process or thermal transfer process to an optional color previously and forming images on the transfer material.

In accordance with the present invention, there is provided a transfer material for use in thermal transfer comprising a substrate and a dye receiving layer, wherein the transfer material is colored to a predetermined color.

Further, the present invention provides a material of forming images of a sepia tone of forming images to a transfer material having a sepia tone as a predetermined color.

The present invention further provides a method of forming sepia tone images which comprises laminating a laminate film colored to a sepia tone.

In particularly embodiments, such a transferred material for use in thermal transfer includes those in which a substrate or a dye receiving layer is colored to a predetermined color, or an intermediate layer disposed between the substrate and the dye receiving layer is colored to a predetermined color, as well as in which the substrate, the intermediate layer or the dye receiving layer constituting the transfer material is colored and, in addition, a printing layer is formed between each of the layers, thereby coloring the transfer material. Further, there is also provided an embodiment in which an average tone preferably provided to the transfer material has a distance 1 from an origin of not less than 10, and L* of not less than 40, assuming L*=100, a*=0, b*=0 as origin in L*a*b* calorimetric system.

In accordance with the present invention, there is also provided a method of forming thermal transfer images of a predetermined color by forming the images by a thermal transfer process to a colored transfer material for use in thermal transfer.

According to the thermal transfer image forming method of the present invention, images of desired tones including sepia tone can easily be formed by using a existent thermal transfer recording process.

BRIEF DESCRIPTION OF ACCOMPANYING DRAWINGS

The present invention is to be explained more in details by way of preferred embodiments with reference to the drawings. In each of the drawings, identical reference numerals represent identical or similar constituent factors.

DETAILED DESCRIPTION OF THE PREFERRED EMBODIMENTS

Figure 1:
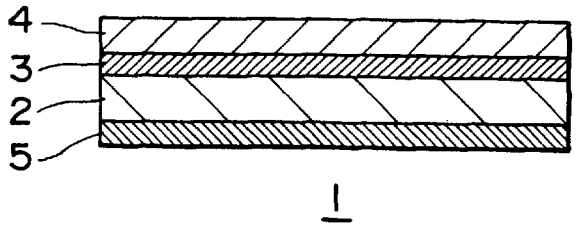
FIG. 1 is a cross sectional view of a transfer material for use in thermal transfer used in the present invention.

FIG. 1 is a cross sectional view for one embodiment of a transfer material, that is, thermal transfer print paper 1 for use in thermal transfer according to the present invention. The transfer material 1 for use in thermal transfer basically has a laminate structure comprising a sheet-like substrate 2, an intermediate layer 3 and a dye receiving layer 4 formed on the surface of the substrate 2, and a back coat layer 5 formed on the rear face of the substrate 2. Among them, the intermediate layer 3 is disposed optionally for ensuring adhesion of the substrate 2 and the dye receiving layer 4 and for improving abutment to a heat sensitive head upon printing in a thermal transfer printer thereby improving the printability. Further, the back coat layer 5 is disposed optionally for ensuring mainly the running property in the printer.

In the present invention, the transfer material is colored to a predetermined color by previously coloring at least one layer of the substrate 2, the intermediate layer 2 or the dye receiving layer 4 of the transferred material 1, or by forming a printing layer between each of the layers, namely, between the substrate 2 and the intermediate layer 3 or between the intermediate layer 3 and dye receiving layer 4.

Accordingly, as the substrate 2, any substrate used as existent thermal transfer print paper can be used. Further, not only the substrate for the existent print paper but also other substrates may also be used. For example, there can be used synthetic paper (for example, polyolefine, polystyrene or vinyl chloride paper), natural fiber paper (high quality paper, art paper, coated paper, cast coated paper), plastic film (polyolefin, polyvinyl chloride, polyethylene terephthalate, polystyrene, polycarbonate and polymethacrylate, etc.), as well as, a laminate comprising an optional combination of them.

As a typical laminate, there can be mentioned, for example, polyolefine synthetic paper/coated paper/polyolefine synthetic paper, or polyolefine synthetic paper/polyethylene terephthalate film/polyolefine synthetic paper. Such a laminate is preferred since the printing density is high due to micro-voids of the polyolefinic synthesis paper and curling upon printing can be prevented due to the laminate structure.

Usually, the thickness of the substrate 2 is preferably from 50 to 250 $\mu$m, with no particular restriction.

As the intermediate layer 3, thermoplastic resin can be used such as polyurethane resin, polyester resin, chlorinated polyolefin resin and acrylic resin. Further, an antistatic agent or conductive polymer may be added to the intermediate layer 3 for providing an antistatic property. As the antistatic agent, there can be used various surface active agents such as cationic surface active agent (quarternary ammonium salt, polyamine, etc.), anionic surface active agent (alkyl benzene sulfonate, sodium alkyl sulfate ester, etc.), amphoteric surface active agent and nonionic surface active agent. Further, as the conductive polymer, cationic acrylic resin, or the like may be used.

Further, a white pigment may be added optionally to the intermediate layer 3 in order to improve the hiding power and coloring property. As the white pigment, titanium oxide, zinc oxide, kaolin, clay, calcium carbonate or silica can be used.

Usually, the thickness of the intermediate layer 3 is preferably from 0.5 to 50 $\mu$m, with no particular restriction.

The dye receiving layer 4 can be constituted in the same manner as that used for existent thermal transfer print paper. The dye receiving layer 4 can be formed, for example, with dyeing resin such as polyester, cellulose, ester, polyvinyl butyral, polycarbonate or polyvinyl chloride type resin. Usually, the thickness of the dye receiving layer 4 is preferably from 1 to 20 $\mu$m.

Further, various additives can also be incorporated optionally to the dye receiving layer 4. For example, a white pigment or antistatic agent can be added in the same manner as the intermediate layer 3. The antistatic agent may be coated on the surface of the dye receiving layer 4.

Further, UV-absorbing agent, light stabilizer, antioxidant or the like can be added as necessary in order to improve the storability of images. As the UV-absorbing agent, there can be used salicylic acid derivative, benzophenone derivative, benzotriazole derivative or oxalic anilide derivative. As the light stabilizer, hindered amine compound or the like can be used. As the antioxidant, hindered phenol type or phosphite ester type compound can be used.

In a case of printing by using an ink ribbon in a thermal transfer printer, various kinds of releasing agents can be added optionally so that releasability from the ink ribbon can be ensured. As the releasing agent, there can be used, for example, silicone oil and modification product thereof, fluoro surface active agent, fatty acid, fatty acid ester and phosphate ester.

On the other hand, the back coat layer 5 can be formed, for example, with acrylic resin, cellulose ester resin or butyral resin. Particularly, when a print paper is overlapped on images of another print paper formed with images, a resin of relatively high Tg is used for preventing images from transferring to the rear face of the overlaid print paper. Further, the back coat layer 5 is properly blended with various kinds of additives, for example, organic or inorganic fillers, releasing agents and antistatic agents. The releasing agent and the antistatic agent may be coated on the surface of the back coat 5 in addition to internal addition to the back coat layer 5. Further, the back coat layer 5 may be a layer provided with a scriptability for an aqueous ink.

Usually, the thickness of the back coat layer 5 is preferably from 0.5 to 30 $\mu$m.

The-transfer material 1 having the laminate structure comprising the substrate 2, the intermediate layer 3, the dye receiving layer 4 and the back coat layer 5 can be laminated by a customary method. For example, the transfer material 1 can be prepared by coating a composition for forming a back coat layer, a composition for forming an intermediate layer and a composition for forming a dye receiving layer successively on the substrate 2, for example, by a pipe coater, roll coater, gravure coater or dye coater. The transfer material 1 can be prepared also by coating the composition for forming the back coat layer, the composition for forming the intermediate layer and the composition for forming the dye receiving layer in an inline system by using a multi-head coater. Further, the transfer material can also be prepared by laminating each of the layers onto the substrate 2 by extrusion.

As described above, in the present invention, at least one of the substrate 2, the intermediate layer 3 and the dye receiving layer 4 of the transfer material 1 is previously colored to a predetermined color, or a printing layer is formed between each of the layers thereby coloring the transfer material to the predetermined color.

In this case, the substrate 2, the intermediate layer or the dye receiving layer 4 can be colored by properly using various kinds of organic pigments, inorganic pigments, as well as direct dyes, acidic dyes, basic dyes, oleosoluble dyes and dispersible dye, with no particular restriction also for the coloring method for each of the layers.

For example, when natural fiber paper constituting the substrate 2 is colored, cellulose pulp can be dyed by a direct dye or an acidic dye. In a case of coloring the coated paper or the like, the coated paper can be colored by internally adding the pigment or the dye described above to the coating layer. The plastic film or the synthesis paper can also be colored by internal addition of the pigment or the dye, or can be dyed by using a coating solution containing a dye or pigment.

The intermediate layer 3 and the dye receiving layer 4 can be colored by internally adding the pigment or the dye described above to a resin composition in a case of forming the layers by coating, or to a resin composition in a case of forming each of the layers by extrusion lamination.

Further, in a case of forming the printing layer between-the substrate 2 and the intermediate layer 3, the printing layer may be formed on the substrate 2 and the intermediate layer 3 may be formed thereon upon preparing the transferred material. In a case of forming the printing layer between the intermediate layer 3 and the dye receiving layer 4, the printing layer may be formed on the intermediate layer and then the dye receiving layer 4 may be formed further thereon.

As a method of forming the printing layer on the substrate 2 or the intermediate layer 3, there can be mentioned, for example, gravure printing or offset printing. In this case, those printing inks employed usually can be used and it is preferred that the ink used gives no undesired effect after printing on the adhesion of the intermediate layer 3 and the dye receiving layer 4 formed on the print layer, printability, etc.

There is also no particular restriction on the printing pattern. It may be a solid pattern or various other patterns such as a grain pattern, marble, pattern or brick-like pattern may be adopted.

When the transfer material 1 is provided with a predetermined color by coloring the substrate 2, inter-mediate layer 3 or the dye receiving layer 4, or the transfer material 1 is provided with a predetermined color by forming the printing layer between each of the layers, a preferred color as an average tone of the transferred material, has a distance 1 from an origin represented by the following equation of not less than 10 and L* of not less than 40 in L*a*b* calorimetric system, assuming L*=100, a*=0, b*=0 as the origin.

$$l=((100-L^*)^2+(a^*)^2+(b^*)^2)^{1/2}$$

That is, the value l is a distance from an imaginal white color and gives an index representing the degree of coloration. Then, if value l is as small as less than 10, coloration is insufficient to provide no sufficient coloring effect. Further, if L* is as small as less than 40, the color is too dark and a dynamic range of images is excessively small, which is not easy to see. There is no particular restriction on the hue or the saturation.

Accordingly, as a concrete example of a preferred color provided to the transfer material 1, there can be mentioned a color of light green tone at about L*=65, a*=−20, b*=35.

According to JIS-Z 8102, the sepia color is specified as 10YR 2.5/2 in the Mansell system. It is shown in the L*a*b* system as a value at about L*=25, a*=4, b*=13. However in the present invention, the color is not restricted to such numerical values. In the present invention, the sepia tone means such a tone as giving discolored and aged impression to the images and having, preferably, L*=50–90, a*=0–30, b*=10–45, more preferably, L*=70–85, a*=5–15, b*=20–35. If L* is excessively large, the color is too light to weaken the aged impression. If L* is excessively small, the color is too dark and the dynamic range of the images is too narrow to see easily. Further, if a* or b* deviates largely from the above mentioned range, the aged impression is lost and, further, it is separated greatly from the sepia color.

As described above, thermal transfer recording can be conducted by a customary method to the transfer material 1, by which black and white or color images having a predetermined tone can be formed. For example, hard copies with images toned to various colors can be obtained, for example, by using a thermal transfer ink ribbon and printing to print paper 1 by a commercially available video printer.

Figure 2:
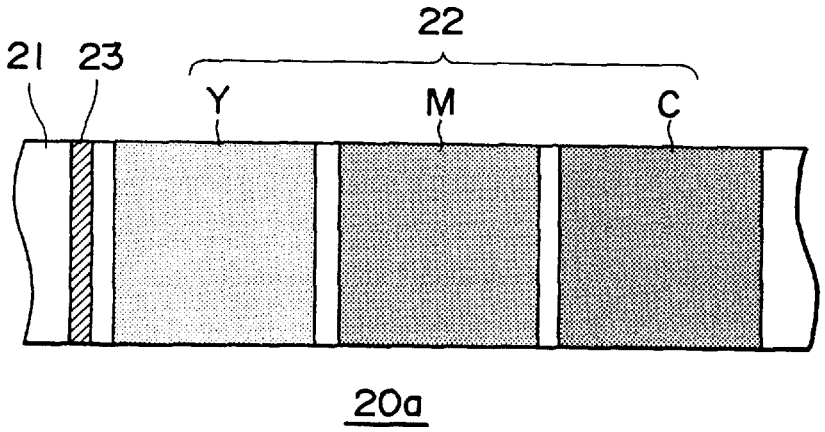
FIG. 2 is a plan view of an ink ribbon for use in thermal transfer which can be used in the present invention.
Figure 3:
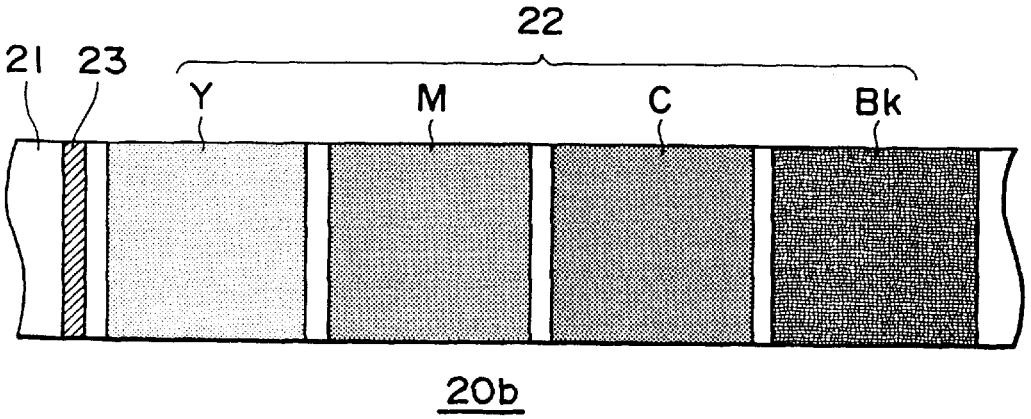
FIG. 3 is a plan view of an ink ribbon for use in thermal transfer which can be used in the present invention.
Figure 4:
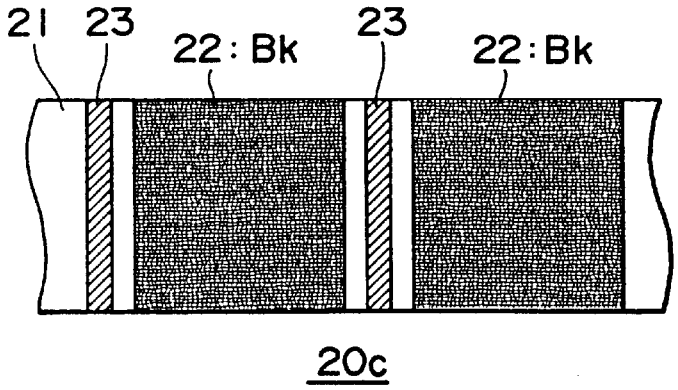
FIG. 4 is a plan view of an ink ribbon for use in thermal transfer which can be used in the present invention.

In this case, there is also no particular restriction on the ink ribbon used. For example, there can be used an ink ribbon 20*a* as shown in FIG. 2 that is, an ink ribbon for forming color images, in which ink layers 22 for each of colors yellow Y, magenta M and cyan C are formed face-by-face successively on the substrate 21 and a sensor mark 23 is further formed, an ink ribbon 20*b* as shown in FIG. 3, having ink layers for each of colors yellow Y, magenta M, cyan C, as well as black ink layer Bk as the ink layer 22. Further, an ink ribbon 20 for forming black and white images as shown in FIG. 4 in which only the black ink layer Bk is formed as the ink layer 22 on the substrate 21 can also be used.

Figure 5:
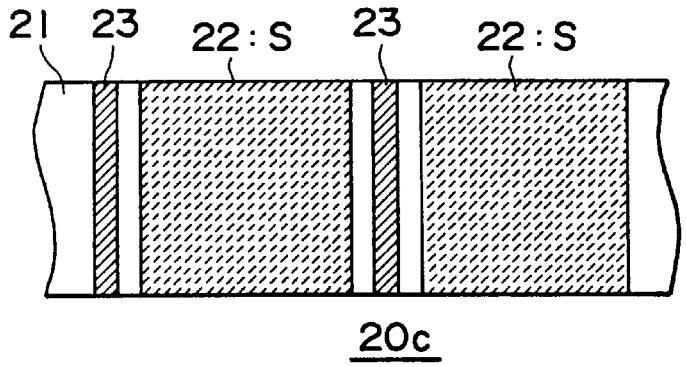
FIG. 5 is a plan view of an ink ribbon for use in thermal transfer which can be used in the present invention.
Figure 6:
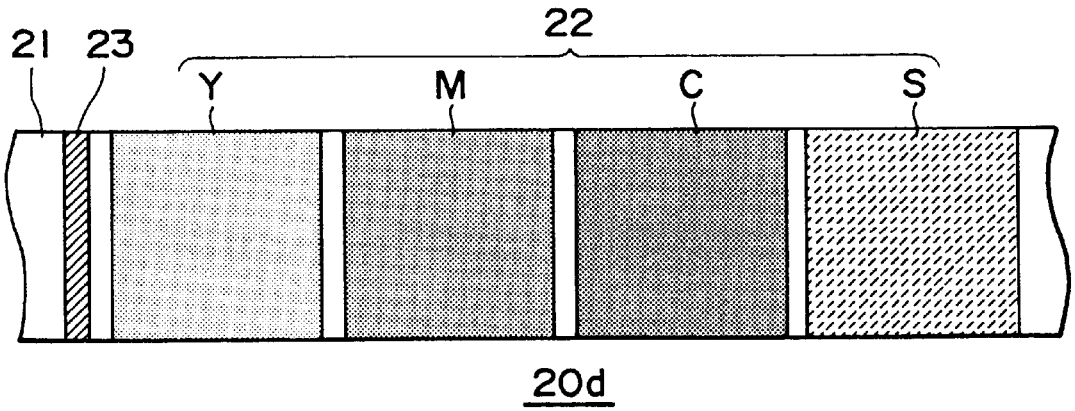
FIG. 6 is a plan view of an ink ribbon for use in thermal transfer which can be used in the present invention.

Further, there can be also used an ink ribbon 20*e* as shown in FIG. 5, in which only the ink layer S toned to a predetermined color such as a sepia tone is formed on a substrate 21, or an ink ribbon 20*e* as shown in FIG. 6 for forming a color images in which an ink layer S toned to a predetermined color is disposed instead of a black ink layer Bk of the ribbon having as an ink layer 22, yellow Y, magenta M, cyan C, black ink layer Bk.

In the present invention, the laminate layer may be colored to a desired color. In this case, the laminate layer 24 can be colored by using various kinds of dyes or pigments in the same manner as in the case of coloring each of the layers for the transfer material 1 described previously.

Figure 9:
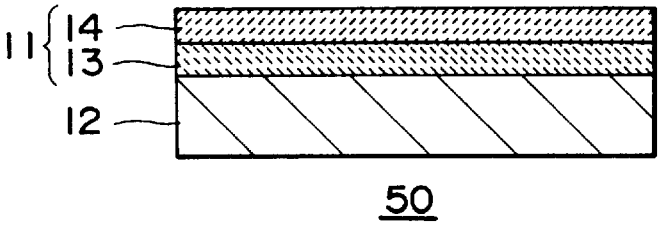
FIG. 9 is a cross sectional view of a laminate film with a releasable substrate used in the present invention.

FIG. 9 is a cross sectional view for one embodiment of a laminate film 50 with a releasable substrate that can be used in the present invention. The laminate film 50 with the releasable substrate basically comprises a laminate film 11 and a substrate 12 in which the laminate film 11 has a laminate structure comprising a releasing protection layer 13 and an adhesion layer 14.

As a method of using the laminate film 50 with the releasable substrate, at first the adhesion layer 14 of the laminate film 50 with the releasable substrate is overlapped and adhered to the image surface to be provided with the sepia tone. In this case, pressing is applied, for example, by a roller or the like or heat pressing is applied by using a heat laminator as necessary. Then, the substrate 12 peeled and removed thereby laminating the laminate film 11 comprising the adhesion layer 14 and the releasing protective layer 13 to the image surface.

The releasing protection layer 13 and the adhesion layer 14 constituting the laminate film 11 have a function as a coloring film for providing the images with the sepia tone by the effect of one or both of them. The releasing protection film layer 13 further has a function of improving the releasability between the substrate 12 and the laminate film 11, as well as constituting the uppermost layer on the images after the lamination of the laminate film 11 on the images thereby protecting the images from contaminates, skin fats, moisture, UV-rays, etc. Further, the adhesion layer 14 has a function of improving the adhesion between the laminate film 11 and the images.

As the substrate 12 of the laminate film 50 with the releasable substrate, those identical with the substrate for the laminate film employed so far for image protection and other various film-like substrates can be used. For example, a plastic film of about 25 to 200 μm thickness (for example, made of polyolefin, polyvinyl chloride, polyethylene terephthalate, polystyrene, polycarbonate and polymethacrylate) can be used. Further, a laminate film comprising a plurality kinds of plastic films may also be used.

As the releasing protection layer 13, a thermoplastic resin such as acrylic resin, cellulose ester resin or polyvinyl butyral resin can be used. Further, a releasing agent such as silicone oil or fluoro surface active agent may be added for improving the releasability from the substrate 12, and an antistatic agent can be added for providing antistatic property to the releasing protection layer 13. In this case, various surface active agents can be used as the antistatic agent, for example, cationic surface active agent (quarternary ammonium salt and polyamine), anionic surface active agent (alkyl benzene sulfonate or sodium alkyl sulfate ester), amphoteric surface active agent and nonionic surface active agent.

In addition, various kinds of additives can be blended as necessary to the releasing protection layer 13. For instance, UV-ray absorber, light stabilizer, anti-oxidant or the like can be added for improving the store stability of images. As the UV-ray absorber, there can be mentioned, for example, salicylic acid derivative, benzophenone derivative, benzotriazole derivative or oxalic acid anilide derivative. Further, as the light stabilizer, there can be mentioned, for example,. hindered amine compound. As the antioxidant, there can be mentioned, for example, hindered phenone compound or phosphorus ester compound.

The thickness of the releasing protection layer 13 can be determined properly, for example, depending on the use of images for which the laminate film 11 is laminated and working circumferences and it is generally preferable to be not less than 5 μm and, more preferably from 5 to 50 μm.

The adhesion layer 14 can be formed with a thermoplastic resin such as polyester, cellulose ester, polyvinyl chloride, urethane, ethylene-vinyl acetate copolymer and adhesives such as acrylic or rubber adhesive. The material for forming the adhesion layer 14 is preferably selected properly depending on the constituent material for the images. Particularly, when the images are formed by an ink jet or thermal transfer process, the material is selected such that the dye forming the images do not exude to the adhesion layer 14.

Further, in the same manner as in the releasing protection layer 13 described above, various kinds of additives may be added, depending on the requirement, also to the adhesion layer 14.

The thickness of the adhesion layer 14 can be determined properly depending, for example, on the adhesion between the substrate 12 and the releasing protection layer 13 and preferably it is from 5 to 50 μm.

In the present invention, at least one of the releasing protection layer 13 and the adhesion layer 14 constituting the laminate film 11 is colored so that the images laminated with the laminate film 11 are colored to the sepia tone.

As a method of coloring the laminate film 11 so that the images are colored to the sepia tone, various kinds of dyes such as a direct dye, an acidic dye, a basic dye, an oil dye, a dispersible dye may be blended properly to the releasing protection layer 13 or the adhesion layer 14 constituting the laminate film 11. Also an organic or inorganic pigment may be added properly so long as it does not degrade the transparency of the laminate film 11. Further, as a method of coloring by using the dye or the pigment, dyeing can be applied by internally adding the dye or the pigment to a resin composition as the material forming the releasing protection layer 13 or the adhesion layer 14, or by using a coating solution containing a dye or a pigment after coating the resin composition on the substrate 12.

The laminate film 50 with the releasing substrate can be prepared by a customary method. For example, the laminate film can be formed by preparing a composition for forming the releasing protection layer and a composition for forming the adhesion layer respectively, coating the composition for forming the releasing protection layer and the composition for forming the adhesion layer successively on the substrate 12 by using, for example, a pipe coater, a roll coater, a gravure coater or die coater and then drying them. Further, the laminate film can be formed also by laminating each of the compositions on the substrate 12 by extrusion.

Descriptions have been made to the laminate film 50 with the releasable substrate shown in FIG. 9, the laminate film or the laminate film with the releasable substrate used in the present invention may take various other forms. For example, the laminate film 50 with the releasable substrate in FIG. 9 shows an example in which the laminate film comprises a laminate structure of the releasing protection layer 13 and the adhesion layer 14, but a laminate film as a single layer of laminate film comprising them in integration and having a function of the releasing protection layer and the adhesion layer together, and formed on the substrate may also be used.

Further, if necessary, a releasing layer may be disposed between the substrate 12 and the laminate film 11 for improving the releasability between them. In this case, the releasing layer may be peeled and removed together with the substrate 12 or the releasing layer may laminate the images together with the laminate film 11, when the substrate 12 and the laminate film 11 are peeled.

Figure 10:
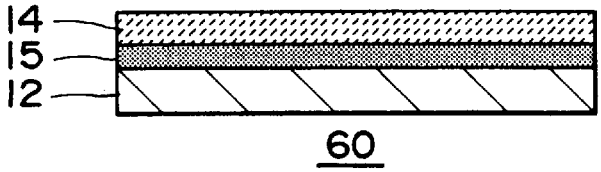
FIG. 10 is a cross sectional view of a laminate film used in the present invention.

Further, as the laminate film 60 shown in FIG. 10, the adhesion layer 14 and the substrate 12 may be adhered by the intermediate layer 15 as necessary to integrally laminate the images. In this case, the material for constituting the intermediate layer 15 may be selected properly depending on the constituent material for the adhesion layer 14 and the substrate 12 and, for example, it may be formed with a thermoplastic resin, for example, polyurethane resin, polyester resin, chlorinated polyolefin resin and acrylic resin.

Further, in the laminate film 60 shown in FIG. 10, a dye or a pigment may be blended as necessary also to the intermediate layer 15 or the substrate 12 in addition to the adhesion layer 14 such that images laminated with the laminate film 60 are colored to the sepia tone. Further, the substrate 12 in this case, is formed with a light permeable material so that the images can be seen through the laminate film 60 laminated on the images.

Figure 11A:
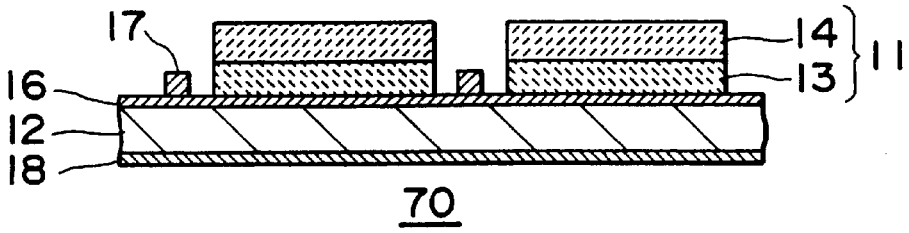
FIG. 11A is a cross sectional view and FIG. 11B is a plan view of a thermal transfer ribbon used in the present invention.
Figure 11B:
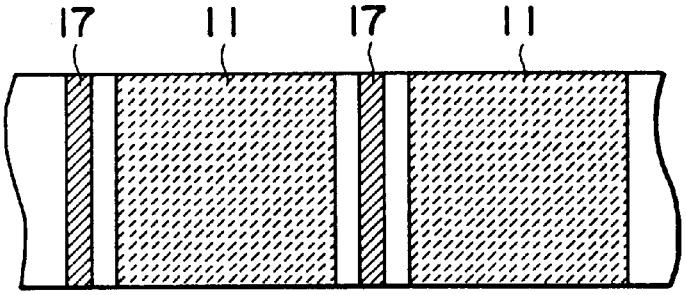

Further, the laminate film usable in the present invention may also be formed in a thermal transfer ribbon such that it can be used in a thermal transfer printer. FIG. 11A is a cross sectional view for one example of such a thermal transfer ribbon 70 and FIG. 11B is a plan view thereof. The illustrated thermal transfer ribbon 70 has a primer layer 16 on a substrate 12 and a rectangular region of a laminate film 11 comprising a releasing protection layer 13 and an adhesion layer 14 is formed on the primer layer 16, and a sensor mark 17 is formed between adjacent rectangular laminate film regions. Further, a heat resistant lubricant layer 18 is formed to the surface of the substrate 12 on the side opposite to the laminate film 11.

In the thermal transfer ribbon 70, each of the substrate 12, the primer layer 16, the sensor mark 17 and the heat resistant lubricant layer 18 can be formed in the same manner as each of the layers in existent thermal transfer ink ribbons. For example, a plastic film of about 3 to 15 $\mu$m thickness (polyethylene terephthalate, polycarbonate, polyimide or polyamide) can be sued for the substrate 12.

Further, the heat resistant lubricant layer 18 is formed for ensuring smooth running of the thermal transfer ribbon 70 in the thermal transfer printer and it can be formed, for example, with a resin having a high softening point such as cellulose acetate or polyvinyl butyral. Further, a lubricant such as silicone oil, wax, fatty acid amide or filler may be added to the resin layer.

When the thermal transfer ribbon 70 is used for the thermal printer, the laminate film 11 is pressed under heating by a thermal head to the image surface of the transfer material on which the images are formed and transferred on the images. Accordingly, the laminate film 11 is also colored to the sepia tone like that the laminate film 11 in the laminate film 50 with the releasing substrate shown in FIG. 9.

Figure 12:
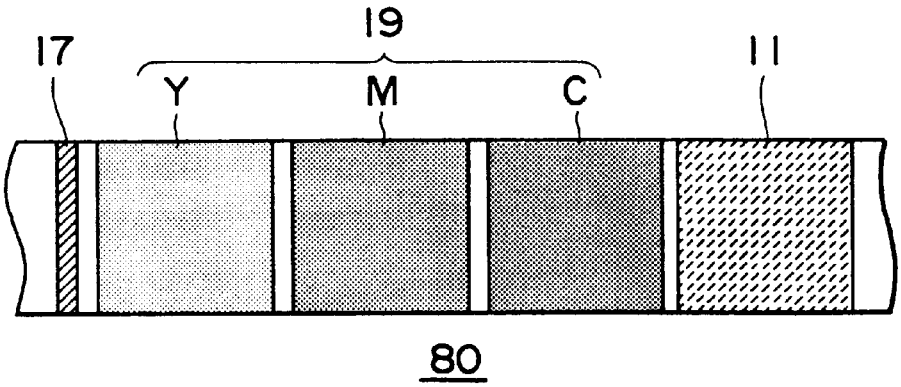
FIG. 12 is a plan view of an ink ribbon having a laminate film integrated with an ink ribbon used in the present invention.

In the present invention, the laminate film 11 can be formed also in the thermal transfer ink ribbon. In this case, after the images are formed in the thermal transfer printer by using a thermal transfer ink ribbon, the laminate film can be laminated successively on the images by the thermal printer. FIG. 12 is a plan view for one example of a ribbon 80 having a laminate film and an ink ribbon integrated together. The integrated type ribbon 80 shown in the figure comprises a laminate film 11 formed on a primer layer 16 like that the thermal transfer ribbon 70 in FIG. 11. Further, ink layers for each of the colors, i.e., yellow Y, magenta M and cyan C are also formed face-by-face successively on the primer layer 16 as an ink layer 19. In this case, the ink layer 19 may be constituted as a hot melt transfer type ink layer, or may be constituted as a subliming transfer type ink layer.

Figure 13:
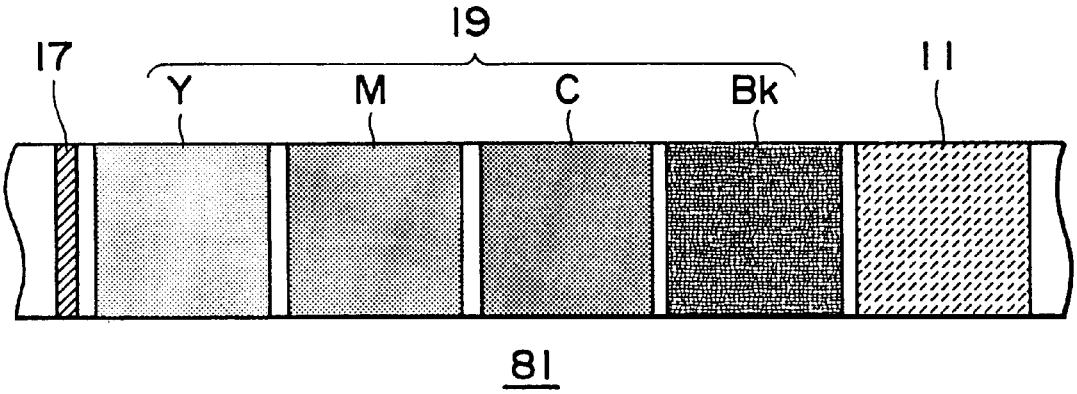
FIG. 13 is a plan view of an ink ribbon having a laminate film integrated with an ink ribbon used in the present invention.
Figure 14:
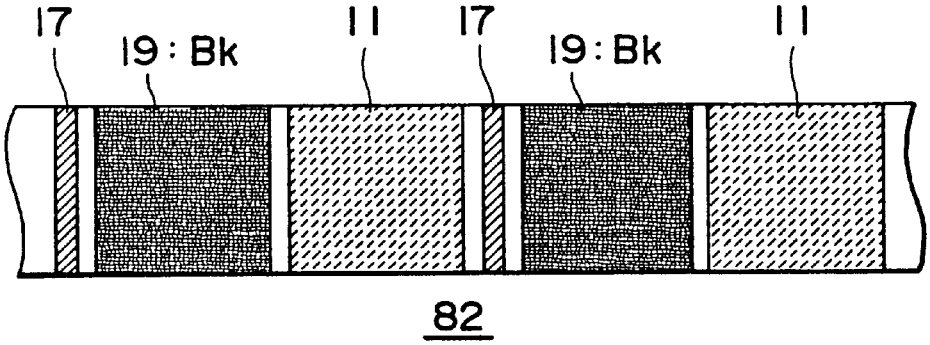
FIG. 14 is a plan view of an ink ribbon having a laminate film integrated with an ink ribbon used in the present invention.

The laminate film-ink ribbon integrated type ribbon 81 shown in FIG. 13 is similar to the laminate film-ink ribbon integrated type ribbon like shown in FIG. 12, in which yellow Y, magenta M, cyan C, as well as black ink layer Bk are disposed as the ink layer 19. Further, a laminate film-ink ribbon integrated type ribbon 82 in FIG. 14 is also similar to a laminate film-ink ribbon integrated type ribbon in FIG. 12, in which a black ink layer Bk is disposed and further, a laminate film 11 colored to the sepia tone is disposed as the ink layer 19. According to the integrated type ribbon in FIG. 12 or 13, color images of the sepia tone can be formed satisfactorily. According to the integrated type ribbon shown in FIG. 14, black and white images of the sepia tone can be formed satisfactorily.

Further, the heat transfer ink ribbon having an ink layer toned to the sepia tone may be used, and a laminate film toned to the sepia tone may be laminated on the thus formed thermal transfer images, by which satisfactory sepia tone images can also be formed.

Descriptions have been made to a case of using thermal transfer print paper colored to a predetermined tone such as a sepia tone with reference to print paper shown in FIG. 1 in the present invention. However, the present invention is not restricted only thereto but also includes a case of using a transfer material toned to a predetermined color in various image forming methods.

Figure 7:
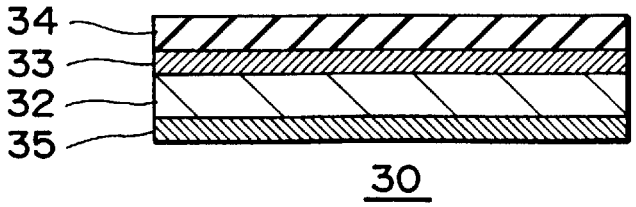
FIG. 7 is a cross sectional view of an ink jet print paper used in the present invention.

For example, FIG. 7 is a cross sectional view for one example of an ink jet transfer material, that is, ink jet print paper 30 that can be used upon practicing the present invention. The ink jet print paper 30 basically has a laminate structure comprising a sheet-like substrate 32, an intermediate layer 33 and an ink receiving layer 34 formed on the surface thereof and a back coat layer 35 formed on the rear face thereof. Among them, the intermediate layer 33 is disposed for ensuring the adhesion between the substrate 32 and the ink receiving layer 34, as well as improving the smoothness. Further, the back coat layer 35 is disposed optionally mainly for insuring the running property in a printer.

The substrate 32, the intermediate layer 33 and the back coat layer 35 constituting the ink jet print paper 30 may be constituted substantially in the same manner as the substrate 2, the intermediate layer 3 and the back coat layer 5 for the thermal transfer print paper 1 in FIG. 1 described previously.

Further, the ink receiving layer 34 may be formed with vinyl resin such as polyvinyl alcohol, carboxylated polyvinyl alcohol or polyvinyl pyrrolidone, cellulose resin such as hydroxyethyl cellulose and hydroxypropyl cellulose, starch such as potato starch, oxidized starch or corn starch, polyacrylate resin such as sodium acrylate, partially saponifying product of polyacrylate ester, maleic acid anhydride resin such as ethylene-maleic acid anhydride copolymer, vinyl acetate-maleic acid anhydride copolymer, as well as various water soluble or hydrophilic resins such as gelatin, casein, polyethylene oxide, etc.

Further, pigments such as clay, talc, calcium carbonate, barium sulfate, zinc oxide, titanium oxide and silica, various kinds of surface active agents and UV-ray absorbers can be added properly to the ink receiving layer 34.

Further, a curing agent such as isocyanate, melamine or glyoxal can be added, as necessary, to the ink receiving layer 34 for improving the water proofness.

In a case of forming images device by an ink jet process in the present invention, at least one of the layers of the substrate 32, the intermediate layer 33 and the ink receiving layer 34 constituting the ink jet print paper 30 is colored to a predetermined color such as a sepia tone. Then, ink jet images are formed to the print paper 30 by a customary method. This enables to form jet images having tone of a predetermined color conveniently.

Figure 8:
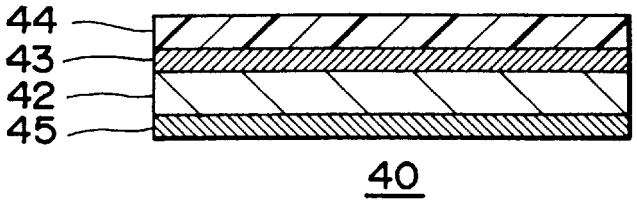
FIG. 8 is a cross sectional view of a silver salt photographic paper used in the present invention.

FIG. 8 is a cross sectional view for one embodiment of a transfer material for use in silver salt photography, that is, silver salt photographic paper 40 which can be used in the present invention. The silver salt photographic paper 40 basically has a laminate structure comprising a sheet-like substrate 42, an intermediate layer 43 and a light sensitive emulsion layer 44 formed on the surface, and a back coat layer 45 formed on the rear face of the substrate 42. Among them, the intermediate layer 43 is disposed for ensuring adhesion of the substrate 42 and the light sensitive emulsion layer 44, or improving the smoothness thereof. Further, the back coat layer 45 is disposed, as necessary, in order to ensure mainly the antistatic property.

The substrate 42, the intermediate layer 43, and the back coat layer 45 constituting the silver salt photographic paper 40 can be constituted generally in the same manner respectively as that for the substrate 2, the intermediate layer 3 and the back coat layer 5 for the thermal transfer pigment paper 1 described above and illustrated in FIG. 1.

The light sensitive emulsion layer 44 is formed with an emulsion in which a silver halide such as silver bromide, silver chloride or silver iodide is dispersed in the form of fine crystals in gelatin. Further, a spectrally sensitizing dye, a sensitizer, a stabilizer, a UV-ray absorber, a film hardener and a plasticizer are added as necessary as the additives to the light sensitive emulsion layer 44. Further, the light sensitive emulsion layer 44 is constituted as a multi-layered structure usually comprising a protection layer, a filter layer and emulsion layers sensitive to each of colors (blue, red, green), particularly, in a case of color photographic paper.

In the present invention, in a case of forming images by a silver salt photographic process, at least one of layers of the substrate 42, the intermediate layer 43 and the sensitive emulsion layer 44 used for constituting the silver salt photographic paper 40 is generally colored to a predetermined color such as a sepia tone. Preferably, those in which the substrate 42 or the intermediate layer 43 is colored to the sepia tone are used such that the light sensitive characteristic of the light sensitive emulsion layer 44 does not suffers from the effect. Then, silver halide photographic images are formed by exposing and developing such photographic paper by a customary method, which enables to form silver salt photographic images having a tone of a predetermined color conveniently.

EXAMPLES

The present invention will be explained more specifically with reference to examples.

Examples 1–4

Polypropylene synthetic paper (YUPO FPG-80 (80 μm thickness), manufactured by Ohji Yuka Synthetic Paper Co., Ltd.), coat paper of 104 g/m$^2$ and polypropylene synthetic paper (YUPO PEARL (75 μm thickness), manufactured by Ohji Yuka Synthetic Paper Co., Ltd.) were appended as three layers of YUPO PEARL/coat paper/FPG-80 by using polyester adhesives to form a laminate, and the laminate was used as a substrate sheet. A coating stock solution for image receiving layer comprising the following compositions (a), (b), (c) and (d) was prepared by mixing each of them at a blending ratio shown in Table 1 as the dye receiving to form coating solutions for dye receiving layer, which were coated to the YUPO PEARL surface of the laminate at a coating thickness after drying of about 8 μm, to obtain a transfer material of examples.

Composition for stock coating solution for use in dye receiving layer (a)

| | | |
|---|---|---|
| Orange dye (MS ORANGE EX-30, manufactured by Mitsui Toatsu Dye Co.) | 1.0 | wt % |
| Cellulose acetate butyrate (CAB 551-0.2, manufactured by Eastman Chemical Co.) | 20.2 | wt % |
| Dicylohexyl phthalate | 4.0 | wt % |
| Modified silicone oil (SF8427, manufactured by Toray Dow Corning Silicone Co,) | 1.0 | wt % |
| Polyisocyanate (COLONATE L-45E, manufactured by Nippon Polyurethane Industry Co.) | 1.2 | wt % |
| Methyl ethyl ketone | 36.3 | wt % |
| Toluene | 36.3 | wt % |

Composition for stock coating solution for use in dye receiving layer (b)

| | | |
|---|---|---|
| Blue dye (MS BLUE HSO-43, manufactured by Mitsui Toatsu Dye Co.) | 1.0 | wt % |
| Cellulose acetate butyrate (CAB 551-0.2, manufactured by Eastman Chemical Co.) | 20.2 | wt % |
| Dicylohexyl phthalate | 4.0 | wt % |
| Modified silicone oil (SF8427, manufactured by Toray Dow Corning Silicone Co,) | 1.0 | wt % |
| Polyisocyanate (COLONATE L-45E, manufactured by Nippon Polyurethane Industry Co.) | 1.2 | wt % |
| Methyl ethyl ketone | 36.3 | wt % |
| Toluene | 36.3 | wt % |

Composition for stock coating solution for use in dye receiving layer (c)

| | | |
|---|---|---|
| Red dye (BAYFAX VPSN2670, manufactured by Bayer Japan Co.) | 1.0 | wt % |
| Cellulose acetate butyrate (CAB 551-0.2, manufactured by Eastman Chemical Co.) | 20.2 | wt % |
| Dicylohexyl phthalate | 4.0 | wt % |
| Modified silicone oil (SF8427, manufactured by Toray Dow Corning Silicone Co,) | 1.0 | wt % |
| Polyisocyanate (COLONATE L-45E, manufactured by Nippon Polyurethane Industry Co.) | 1.2 | wt % |
| Methyl ethyl ketone | 36.3 | wt % |
| Toluene | 36.3 | wt % |

Composition for stock coating solution for use in dye receiving layer (d)

| | | |
|---|---|---|
| Cellulose acetate butyrate (CAB 551-0.2, manufactured by Eastman Chemical Co.) | 20.4 | wt % |
| Dicylohexyl phthalate | 4.1 | wt % |
| Modified silicone oil (SF8427, manufactured by Toray Dow Corning Silicone Co,) | 1.0 | wt % |
| Polyisocyanate (COLONATE L-45E, manufactured by Nippon Polyurethane Industry Co.) | 1.2 | wt % |
| Methyl ethyl ketone | 36.6 | wt % |
| Toluene | 36.7 | wt % |

Example 6

A dye receiving layer was formed by coating a coating solution for use in a dye receiving layer having the following composition (e) on the same substrate as that used in Example 1 to a thickness after drying of about 6 μm, to obtain a transfer material.

Composition for stock coating solution for use in dye receiving layer (e)

| | | |
|---|---|---|
| Orange dye (ESC YELLOW 155, manufactured by Mitsui Toatsu Dye Co.) | 0.05 | wt % |
| Cellulose acetate butyrate (CAB 551-0.2, manufactured by Eastman Chemical Co.) | 20.15 | wt % |
| Dicylohexyl phthalate | 4.00 | wt % |
| Modified silicone oil (SF8427, manufactured by Toray Dow Corning Silicone Co,) | 1.00 | wt % |
| Polyisocyanate (COLONATEL-45E, manufactured by Nippon Polyurethane Industry Co.) | 1.20 | wt % |
| Methyl ethyl ketone | 36.8 | wt % |
| Toluene | 36.8 | wt % |

Example 7

A dye receiving layer was formed by coating a coating solution for use in a dye receiving layer having the following composition (f) on the same substrate as that used in Example 1 to a thickness after drying of about 6 μm, to obtain a transfer material.

Composition for stock coating solution for use in dye receiving layer (f)

| | | |
|---|---|---|
| Magenta dye (ESC BALDOW 451, manufactured by Sumitomo Chemical Industry Co.) | 0.05 | wt % |
| Cellulose acetate butyrate (CAB 551-0.2, manufactured by Eastman Chemical Co.) | 20.15 | wt % |
| Dicylohexyl phthalate | 4.00 | wt % |
| Modified silicone oil (SF8427, manufactured by Toray Dow Corning Silicone Co,) | 1.00 | wt % |
| Polyisocyanate (COLONATE L-45E, manufactured by Nippon Polyurethane Industry Co.) | 1.20 | wt % |
| Methyl ethyl ketone | 36.8 | wt % |
| Toluene | 36.8 | wt % |

Example 8

An intermediate layer was formed by coating the following composition (g) for the intermediate layer on the same substrate as that used in Example 1 to a thickness after drying of about 5 μm, and a dye receiving layer was formed thereon by coating a coating solution of the composition (d) to a thickness after drying of about 6 μm thereon, to obtain a transfer material.

Composition for intermediate layer (g)

| | | |
|---|---|---|
| Blue dye (FORON BLUE SR-PI, manufactured by Sand Co.) | 0.02 | wt % |
| Chlorinated polyolefin (SUPERCHLONE 822, manufactured by Nippon Seishi Co.) | 85.00 | wt % |
| 3-functional epoxy resin (EPOTOTO YH300, manufactured to Toto Kakei Co.) | 3.00 | wt % |
| DBU (tertiary amine catalyst) | 0.20 | wt % |
| Toluene | 11.78 | wt % |

Evaluation

L*a*b* values for each of transfer materials obtained in Examples 1–8 were measured by using a calorimeter (SPM-II, manufactured by GRETAG Co.) and l values were further measured. Then, a portrait was printed to each of the transfer materials by using a color printer (UPC-D7000, manufactured by Sony Corporation) and a black and white ink ribbon (RPC-7020, manufactured by Sony Corporation) and the resultant images were observed visually. The results are shown in Table 1 and Table 2.

TABLE 1

| | Blend ratio of coating solution for dye receiving layer (pbw) | | | | Transferred material | | | |
|---|---|---|---|---|---|---|---|---|
| | Comp.(a) | Comp.(b) | Comp.(c) | Comp.(d) | L* | a* | b* | l |
| Example 1 | 5.0 | 1.0 | 0.5 | 11.0 | 44.0 | 17.3 | 51.3 | 77.9 |
| Example 2 | 5.0 | 1.0 | 0.5 | 23.0 | 58.7 | 9.1 | 41.5 | 59.3 |
| Example 3 | 5.3 | 0.7 | 1.0 | 150.0 | 76.2 | 9.2 | 26.3 | 36.6 |
| Example 4 | 5.0 | 1.0 | 0.5 | 200.0 | 89.1 | −0.82 | 11.5 | 15.9 |

TABLE 2

| | Dye receiving layer | Intermediate layer | Transferred material | | | |
|---|---|---|---|---|---|---|
| | | | L* | a* | b* | l |
| Example 6 | Comp.(e) | — | 94.1 | −20.8 | 58.8 | 62.6 |
| Example 7 | Comp.(f) | — | 82.1 | −12.4 | −21.4 | 30.5 |
| Example 8 | Comp.(d) | Comp.(g) | 80.9 | 18.5 | −18.3 | 32.3 |

As shown in Table 1 and Table 2, the transfer materials of Examples 1 to 8 have L*a*b* values different from each other and provided images having respective unique appearance. Particularly, the transfer materials of Examples 1 to 8 were colored to l value of not less than 10 and L* value of not less than 40 to provide satisfactory images in view of the brightness of the images and coloring effect for the transfer materials.

Example 9

Printing was applied on the same substrate as that used in Example 1 in a brick-like pattern having an average value L* of about 50 using an urethane ink by a gravure printing process, on which a coating solution of the composition (d) was coated to a thickness after drying of about 6 μm to form a dye receiving layer and obtain a transfer material. A color portrait was printed on the thus obtained transfer material by using a color printer (UP-D7000, manufactured by Sony Corporation) and a color ink ribbon (UPC-7010, manufactured by Sony Corporation). As a result, a portrait of unique appearance could be formed.

Examples 10–13, Comparative Example 1

Coating stock solutions for image receiving layers having compositions (a), (b), (c) and (d) were mixed each at a blending ratio shown in Table 1 to prepare coating solutions for dye receiving layers, which were coated to the same substrate as that used in Example 1 to a coating thickness, after drying, of about 8 μm to obtain transfer materials of examples and comparative example.

Evaluation

L*a*b* values for each of transfer materials obtained in Examples 10–13 and Comparative Example 1 were measured by using a calorimeter (SPM-II, manufactured by GRETAG Co.) and l values were further measured. Then, a portrait was printed to each of the transfer materials by using a color printer (UPC-D7000, manufactured by Sony Corporation) and a black and white ink ribbon (RPC-7020, manufactured by Sony Corporation) and the resultant images were evaluated in three steps by visual observation according to the following evaluation criterior by visual. The results are shown in Table 3.

Evaluation criterior

○: Recognized as good sepia tone images

Δ: Recognized as sepia tone but the effect of sepia tone was weak x: Not appropriate as sepia tone images

TABLE 3

| | Blend ratio of coating solution for dye receiving layer (pbw) | | | | Transferred material | | | |
|---|---|---|---|---|---|---|---|---|
| | Comp.(a) | Comp.(b) | Comp.(c) | Comp.(d) | L* | a* | b* | Evaluation |
| Comparative example 1 | 5.0 | 1.0 | 0.5 | 10.0 | 44.0 | 17.3 | 51.3 | X |
| Example 10 | 5.0 | 1.0 | 0.5 | 20.0 | 53.1 | 11.12 | 44.4 | ○ |
| Example 11 | 5.3 | 0.7 | 1.0 | 150.0 | 76.2 | 9.2 | 26.3 | ○ |
| Example 12 | 5.5 | 0.5 | 1.0 | 250.0 | 86.1 | 6.6 | 20.3 | ○ |
| Example 13 | 5.5 | 0.7 | 0.8 | 400.0 | 92.1 | 2.1 | 12.5 | ○ |

From Table 3, it can be seen that the transfer materials were colored to the sepia tone of about: L*=50–90 and good sepia tone images could be obtained. On the contrary, in the comparative example, sepia tone was not recognized for the transfer material and the sepia tone was neither shown for the resultant images.

Examples 14–22, Comparative Examples 2–8

Coating stock solutions for image receiving layers having the compositions (a), (b), (c) and (d) in Example 1 were mixed each at a blending ratio shown in Table 4 to prepare coating solutions for dye receiving layers, which were coated to a coating thickness, after drying, of about 8 μm to obtain transfer materials of examples and comparative example. In the same manner as in Example 10, L*a*b* values for each of the transfer materials were measured, then a black and white portrait was printed on each of the transfer materials, and the resultant images were evaluated by visual observation. The results are shown in Table 4.

TABLE 4

| | Blend ratio of coating solution for dye receiving layer (pbw) | | | | Transferred material | | | Image |
|---|---|---|---|---|---|---|---|---|
| | Comp.(a) | Comp.(b) | Comp.(c) | Comp.(d) | L* | a* | b* | evaluation |
| Comparative example 2 | 5.0 | 1.0 | 0.0 | 10.0 | 58.2 | 0.6 | 48.2 | Δ |
| Comparative example 3 | 5.0 | 1.0 | 0.0 | 25.0 | 64.3 | −0.9 | 40.8 | Δ |
| Comparative example 4 | 3.5 | 2.5 | 0.5 | 50.0 | 60.8 | 0.0 | 8.4 | Δ |
| Comparative example 5 | 5.0 | 3.0 | 2.0 | 50.0 | 62.4 | 9.8 | 7.4 | Δ |
| Comparative example 6 | 5.0 | 2.0 | 5.0 | 50.0 | 56.1 | 30.8 | 10.5 | Δ |

TABLE 4-continued

| | Blend ratio of coating solution for dye receiving layer (pbw) | | | | Transferred material | | | Image |
|---|---|---|---|---|---|---|---|---|
| | Comp.(a) | Comp.(b) | Comp.(c) | Comp.(d) | L* | a* | b* | evaluation |
| Comparative example 7 | 5.0 | 1.0 | 4.0 | 25.0 | 57.8 | 33.9 | 21.0 | Δ |
| Comparative example 8 | 5.3 | 0.7 | 0.5 | 15.0 | 62.1 | 14.0 | 49.4 | Δ |
| Example 14 | 4.0 | 2.0 | 0.5 | 25.0 | 59.5 | 1.7 | 17.2 | ○ |
| Example 15 | 5.0 | 2.0 | 2.0 | 25.0 | 64.5 | 12.9 | 13.4 | ○ |
| Example 16 | 5.0 | 1.7 | 5.0 | 25.0 | 60.7 | 28.2 | 11.2 | ○ |
| Example 17 | 6.0 | 1.0 | 3.0 | 25.0 | 59.4 | 27.8 | 27.9 | ○ |
| Example 18 | 5.3 | 0.7 | 1.5 | 25.0 | 61.2 | 27.0 | 42.2 | ○ |
| Example 19 | 6.0 | 1.0 | 0.5 | 25.0 | 63.9 | 7.9 | 42.6 | ○ |
| Example 20 | 5.0 | 1.3 | 0.8 | 25.0 | 64.4 | 8.2 | 25.0 | ○ |
| Example 21 | 5.0 | 1.0 | 1.0 | 25.0 | 63.4 | 12.4 | 30.3 | ○ |
| Example 22 | 5.0 | 1.0 | 0.8 | 25.0 | 62.6 | 11.3 | 34.6 | ○ |

From Table 4, it can be seen that the transfer materials were colored to the sepia tone of about: a*=0–30, b*=10–45 and good sepia tone images could be obtained. On the contrary, in the comparative example, sepia tone was not recognized for the transfer materials and the sepia tone was neither shown for the resultant images.

Example 23

A color portrait was printed on the transfer material of Example 21 (thermal transfer sheet) using a color printer (UP-D7000, manufactured by Sony Corporation) and a color ink ribbon (UPC-7010, manufactured by Sony Corporation). As a result, sepia tone images of good color were obtained.

Example 24

A black and white portrait was printed on the transfer material of Example 21 (thermal transfer sheet) using a black and white printer (UP-D7000, manufactured by Sony Corporation) and a color ink ribbon (UPC-7010, manufactured by Sony Corporation). As a result, sepia tone images of good color were obtained.

Example 25

A composition for forming a sepia tone ink layer having the following composition (h) was prepared. On the other hand, the following intermediate layer composition (i) was coated to a PET substrate (0.6 μm thickness) having a back coat layer formed previously to obtain an intermediate layer of a thickness, after drying, of about 0.1 μm, on which the composition for forming the sepia tone ink layer as described above was coated to a thickness, after drying, of about 1 μm using a gravure coater and dried to prepare an ink ribbon for forming sepia tone images.

Composition for forming sepia tone ink layer (h)

| | | |
|---|---|---|
| Orange dye (MS ORANGE EX-30, manufactured by Mitsui Toatsu Dye Co.) | 4.0 | wt % |
| Blue dye (MS BLUE HSO-43, manufactured by Mitsui Toatsu Dye Co.) | 4.0 | wt % |
| Red dye (BAYFAX VPSN2670, manufactured by Bayer Japan Co.) | 2.0 | wt % |
| Polyvinyl acetoacetal resin (DENKABUTYRAL 6000AS, manufactured by Denki Kagaku Industry Co.) | 5.0 | wt % |
| Methyl ethyl ketone | 42.5 | wt % |
| Toluene | 34.5 | wt % |

Composition for intermediate layer (i)

| | | |
|---|---|---|
| Polyurethane (NP-3151, manufactured by Nippon Polyurethane Industry Co.) | 2.0 | wt % |
| Polyisocyanate (COLONATE L-45E, manufactured by Nippon Polyurethane Industry Co.) | 1.0 | wt % |
| Methyl ethyl ketone | 47.0 | wt % |
| Toluene | 50.0 | wt % |

A portrait was printed on the transfer material of Example 11 by using the thus obtained ink ribbon for forming sepia tone images by a color printer (UP-D7000, manufactured by Sony Corporation). As a result, good sepia tone images were obtained.

Example 26

A composition for intermediate layer having the following composition (j) was coated to about 7 μm dry thickness on the same substrate as that used in Example 1 to obtain an intermediate layer. Then, the coating solution of the composition (d) described above was coated to a dry thickness of about 8 μm on the intermediate layer to form a dye receiving layer and obtain a transfer material. When the L*a*b* values were measured in the same manner as in Example 1 for the resultant transfer material, L*=78.1, a*=9.0, b*=24.8. Further, when a portrait was printed in the same manner as in Example 10, good sepia tone images were obtained.

Intermediate layer composition (j)

| | | |
|---|---|---|
| Orange dye (MS ORANGE EX-30, manufactured by Mitsui Toatsu Dye Co.) | 0.0290 | wt % |
| Blue dye (MS BLUE HSO-43, manufactured by Mitsui Toatsu Dye Co.) | 0.0026 | wt % |
| Red dye (BAYFAX VPSN2670, manufactured by Bayer Japan Co.) | 0.0052 | wt % |

-continued

| | | |
|---|---|---|
| Chlorinated polyolefin (SUPERCHLONE 822, manufactured by Nippon Seishi Co.) | 85.0000 | wt % |
| 3-functional epoxy resin (EPOTOTO YH300, manufactured by Toto Kasei Co.) | 3.0000 | wt % |
| DBU (tertiary amine catalyst) | 0.2000 | wt % |
| Toluene | 11.7632 | wt % |

Example 27

A coating solution for a dye receiving layer of the following composition (k) was coated as a dye receiving layer to a dry thickness of about 7 μm to a pearl surface of YUPO of the same substrate as that used in Example 1 to form a dye receiving layer and obtain a transfer material.

Composition for dye receiving layer coating solution (k)

| | | |
|---|---|---|
| Orange dye (MS ORANGE EX-30, manufactured by Mitsui Toatsu Dye Co.) | 0.0564 | wt % |
| Orange dye (MS BLUE HSO-43, manufactured by Mitsui Toatsu Dye Co.) | 0.0075 | wt % |
| Red dye (BAYFAX VPSN2670, manufactured by Bayer Japan Co.) | 0.0106 | wt % |
| Cellulose acetate butyrate (CAB 551-0.2, manufactured by Eastman Chemical Co.) | 20.0000 | wt % |
| Dicylohexyl phthalate | 4.0000 | wt % |
| Modified silicone oil (SF8427, manufactured by Toray Dow Corning Silicone Co,) | 1.0000 | wt % |
| Polyisocyanate (COLONATE L-45E, manufactured by Nippon Polyurethane Industry Co.) | 1.2000 | wt % |
| Methyl ethyl ketone | 36.9000 | wt % |
| Toluene | 36.8255 | wt % |

Example 28

A composition for intermediate layer having the following composition (j) of Example 26 was coated to about 7 μm dry thickness on the same substrate as that used in Example 1 to obtain an intermediate layer. Then, the coating solution of the following composition (l) described above was coated to a drying thickness of about 20 μm on the intermediate layer to form a dye receiving layer, to obtain a transfer material for ink jet.

Composition for ink jet dye receiving layer (l)

| | | |
|---|---|---|
| Vinyl acetate - polyvinyl pyrrolidone copolymer (RUBISCOL VA64, manufactured by BASF Japan Co.) | 30.0 | wt % |
| Methyl ethyl ketone | 35.0 | wt % |
| Toluene | 35.0 | wt % |

Example 29

A composition for intermediate layer having the following composition (j) of Example 26 was coated to about 7 μm dry thickness on the same substrate as that used in Example 1 to obtain an intermediate layer. Then, a silver salt photographic emulsion of a composition (m) formed from the following solution A and the solution B was coated at 40° C. to a dry thickness of about 5 μm on the intermediate layer to form a light sensitive emulsion layer and obtain a silver salt photographic transfer material.

The light sensitive emulsion layer was formed as below. At first, a solution B at 40° C. was poured for 2 min into a solution A kept at 60° C. and, they were aged at 60° C. for 30 min. Then, after cooling, coagulation and fine cutting, they were washed with water for 30 min using running water. 10 g of gelatin and water were added to the emulsion to make the entire amount of the emulsion to 1 kg. Further, the emulsion was aged at 60° C. for 45 min.

Composition for silver salt photographic emulsion (m)

| | | |
|---|---|---|
| Solution A | | |
| Purified water | 600 | cc |
| Gelatin | 74 | g |
| Sodium chloride | 7.6 | g |
| Potassium bromide | 8.9 | g |
| 10% citric acid solution | 20 | cc |
| Solution B | | |
| Purified water | 200 | cc |
| Silver nitrate | 25 | g |

Evaluation

A portrait was printed on the transfer material of Example 27 using a black and white ink ribbon (UPC-7020, manufactured by Sony Corporation) by a color printer (UP-D7000, manufactured by Sony Corporation). Further, color portrait was printed on the ink jet transfer material of Example 28 by using an ink jet printer (Desk Jet 1200 C/PS, manufactured by Hewlett Packard Co.). Further, portrait was exposed and developed on the silver salt photographic transfer material of Example 29.

When images formed on the transfer materials of Examples 27–29 were observed visually, all of them showed good sepia tone. Further, not-image formed areas of the transfer materials of Examples 27–29 after image formation were measured for the L*a*b* values by using a calorimeter (SPM-UUm GRETAG Co.). The results are shown in Table 5.

TABLE 5

| | L* | a* | b* |
|---|---|---|---|
| Example 27 | 77.8 | 10.0 | 26.0 |
| Example 28 | 80.2 | 7.8 | 25.4 |
| Example 29 | 82.5 | 8.8 | 23.2 |

Example 30

A composition for adhesive layer comprising the following composition (n) was coated to a thickness, after drying, of about 25 μm on a transparent film substrate made of polyethylene terephthalate of 100 μm thickness, to form a laminate film.

Composition for adhesion layer (n)

| | |
|---|---|
| Orange dye (MS ORANGE EX-30, manufactured by Mitsui Toatsu Dye Co.) | 0.016 wt % |
| Blue dye (MS BLUE HSO-43, manufactured by Mitsui Toatsu Dye Co.) | 0.002 wt % |
| Red dye (BAYFAX VPSN2670, manufactured by Bayer Japan Co.) | 0.003 wt % |

-continued

| | |
|---|---|
| Vinyl chloride - vinyl acetate copolymer (DENKAVINYL #1000D, manufactured by Denki Kagaku Industry Co.) | 20.000 wt % |
| Buthylbenzyl phthalate (DIASIZER-D160, manufactured by Mitsubishi Kasei Vinyl Co.) | 5.000 wt % |
| Methyl ethyl ketone | 36.479 wt % |
| Toluene | 36.500 wt % |

Example 31

A composition for releasing protection layer comprising the following composition (o) was coated to a thickness, after drying, of about 10 μm on a transparent film substrate made of polyethylene terephthalate of 100 μm thickness and then dried to form a releasing protection layer and, the composition (n) for adhesion layer of Example 1 was coated to a thickness, after drying, of about 30 μm to form a laminate film.

Composition releasing protection layer (o)

| | |
|---|---|
| Cellulose acetate butyrate (CAB 500-5, manufactured by Eastman chemical Co.) | 18.0 wt % |
| Dicyclohexyl phthalate | 2.0 wt % |
| UV-absorber (TINUVIN 900, manufactured by Ciba Geigy Ltd.) | 0.6 wt % |
| Methyl ethyl ketone | 39.7 wt % |
| Toluene | 39.7 wt % |

Example 22

A composition for intermediate layer (p) was coated on the opposite surface of a transparent film substrate made of polyethylene terephthalate of 6 μm thickness applied with heat resistant lubricating treatment to form an intermediate layer, thickness after drying, of about 0.1 μm thickness, on which the following black and white composition (q), composition for releasing protection layer (r) and composition (s) for adhesion layer toned to sepia color were coated by using a gravure coater to a manufacture a thermal transfer ink ribbon of the form shown in FIG. 6. In this case, the thickness for each of the layers after drying was about 1 μm for the ink layer, and about 6 μm for the laminate film layer (releasing protection layer at about 3 μm and adhesion layer at about 3 μm).

Composition for intermediate layer (o)

| | |
|---|---|
| Polyurethane (NP-3151, manufactured by Nippon Polyurethane Industry Co.) | 2.0 wt % |
| Polyisocyanate (COLONATE L45-E, manufactured by Nippon Polyurethane Industry Co.) | 1.0 wt % |
| Methyl ethyl ketone | 47.0 wt % |
| Toluene | 50.0 wt % |

Black and white ink composition (q)

| | |
|---|---|
| Orange dye (MS ORANGE EX-30, manufactured by Mitsui Toatsu Dye Co.) | 4.25 wt % |
| Blue dye (MS BLUE HSO-43, manufactured by Mitsui Toatsu Dye Co.) | 3.75 wt % |
| Red dye (BAYFAX VPSN2670, manufactured by Bayer Japan Co.) | 2.00 wt % |
| Polyvinyl acetoacetal resin (DENKABUTYRAL 6000AS, manufactured by Denki Kagaku Industry Co.) | 5.0 wt % |
| Methyl ethyl ketone | 42.5 wt % |
| Toluene | 42.5 wt % |

Composition releasing protection layer (r)

| | |
|---|---|
| Orange dye (MS ORANGE EX-30, manufactured by Mitsui Toatsu Dye Co.) | 0.0275 wt % |
| Blue dye (MS BLUE HSO-43, manufactured by Mitsui Toatsu Dye Co.) | 0.0025 wt % |
| Red dye (BAYFAX VPSN2670, manufactured by Bayer Japan Co.) | 0.0050 wt % |
| Acryl resin (DELPETT 560F, manufactured Asahi Kasei Industry Co.) | 25.0000 wt % |
| Methyl ethyl ketone | 37.4650 wt % |
| Toluene | 37.5000 wt % |

Composition for adhesion layer (s)

| | |
|---|---|
| Cellulose acetate butyrate (CAB 500-5, manufactured by Eastman chemical Co.) | 25.0 wt % |
| UV-absorber (SEASOAP 703, manufactured by Sipro Kasei Co.) | 3.0 wt % |
| Methyl ethyl ketone | 36.0 wt % |
| Toluene | 36.0 wt % |

Evaluation (I) Preparation of transfer sheet for thermal transfer

For evaluation of laminate films of Examples 30–32, a transfer sheet for thermal transfer as a transfer material of the laminate film was prepared as below. That is, a three-layered substrate sheet of YUPO pearl/coat paper/FPG-80 was obtained by bonding a polypropylene synthesis paper (YUPO FPG-80 (80 μm), manufactured by Ohji Yuka Synthesis Paper Co.), coat paper at 104 g/m$^2$ and polypropylene synthesis paper (YUPO PEARL (75 μm), manufactured by Ohji Yuka Synthesis Paper Co.) using polyester adhesives, and a coating solution for dye receiving layer having the following composition (t) was coated as a dye receiving layer to a thickness of about 8 μm after drying to the YUPO pearl surface, to obtain the transfer sheet for thermal transfer.

Coating solution for dye receiving layer (t)

| | |
|---|---|
| Cellulose acetate butyrate (CAB 551-0.2, manufactured by Eastman chemical Co.) | 20.4 wt % |
| Dicyclohexyl phthalate | 4.1 wt % |
| Modified silicone oil (SF8427, manufactured by Toray Dow Corning Silicone Co.) | 1.0 wt % |
| Polyisocyanate (COLONATE L-45E, manufactured by Nippon Polyurethane Industry Co.) | 1.2 wt % |
| Methyl ethyl ketone | 36.6 wt % |
| Toluene | 36.7 wt % |

(II) Preparation of ink jet transfer sheet

For evaluation of the laminate film of Example 30, an ink jet transfer sheet as the transfer material of the laminate film was prepared as below. That is, the same three-layered substrate sheet as that for the thermal transfer sheet described in (I) above was obtained, a primer layer composition of the following composition (u) was coated to a thickness of about 5 μm after drying to the YUPO pearl surface and, further, the composition for ink receiving layer of the following composition (v) was coated to about 20 μm thickness after drying, to obtain an ink jet transfer sheet.

Composition for primer layer (u)

| | |
|---|---|
| Chlorinated polyolefin (SUPERCHLONE 822, manufactured by Nippon Seishi Co.) | 42.5 wt % |
| 3-functional epoxy resin (EPOTOTO YH300, manufactured by Toto Kasei Co.) | 1.5 wt % |
| DBU (tertiary amine catalyst) | 0.1 wt % |
| Toluene | 55.9 wt % |

Composition for ink receiving layer (v)

| | |
|---|---|
| Vinyl acetate - polyvinyl pyrrolidone copolymer (RUBISCOL VA64, manufactured by BASF Japan Co.) | 30 wt % |
| Methyl ethyl ketone | 35.5 wt % |
| Toluene | 35.5 wt % |

(III) Lamination of laminate film on images and colorimetry

A portrait was printed to the transfer sheet for thermal transfer obtained in (I) above by using a color printer (UP-D7000, manufactured by Sony Corporation) and a black and white ink ribbon (UPC-7020, manufactured by Sony Corporation). Further, a color portrait was printed on the ink jet transfer sheet obtained in (II) above by using an ink jet printer (DeskJet 1200C/PS, manufactured by Hewlett Packard Co.). Further, a portrait was baked as images by a silver salt photographic system to photographic paper manufactured by Fuji Photo Film Co. The laminate film of Example 20 was laminated to each of the three kinds of portraits by using a laminator (IC320, manufactured by Intercosmos Co.), and the laminate film of Example 2 was also thermally transferred on the portrait by thermal transfer in the same manner. L*a*b* values for white areas were measured by using a calorimeter (SPM-II, manufactured by GRETAG Co.). The results are shown in Table 6.

Further, a portrait was printed by using the ink ribbon for thermal transfer obtained in Example 32 and the thermal transfer sheet obtained in (v) by a color printer (UP-D7000, manufactured by Sony Corporation) and, further, a laminate film was laminated. Then, L*a*b* values for the white areas of the obtained images were measured in the same manner. The results are also shown in Table 6.

All of images laminated with the laminate films had satisfactory sepia tone.

TABLE 6

| | Image | L* | a* | b* |
|---|---|---|---|---|
| Example 30 | Thermal transfer | 79.2 | 8.8 | 23.7 |
| Example 30 | Ink jet | 75.2 | 10.1 | 29.0 |
| Example 30 | Silver salt photography | 77.7 | 11.1 | 26.8 |
| Example 31 | Thermal transfer | 77.8 | 10.3 | 26.3 |
| Example 32 | Thermal transfer | 84.8 | 6.7 | 20.2 |

According to the present invention, images of unique appearance not obtained so far can be obtained easily in a case of preparing images by a silver salt photographic process, ink jet method or thermal transfer process. In this case, there is no problem for the toxicity of a treating solution as in a case of changing the existent silver salt photographic images into sepia tone, and there is no requirement for changing the soft wares in the printer or soft wares of the computer as in the case of converting the tones of the images per se into the sepia tone in the existent thermal transfer system.

Further, according to the present invention, sepia tone images can be formed by laminating the laminate film of sepia tone to images formed by optional image forming method such as silver salt photographic process, ink jet process or thermal transfer process.

What is claimed is:

1. A method of forming images of a sepia tone comprising the steps of:

coloring a transfer material to a sepia tone, the transfer material comprising a substrate and a receiving layer;

forming images on the transfer material.

2. The method of claim 1 wherein the step of forming images is further defined by forming images by a process selected from the group consisting of: ink jet process and thermal transfer process.

3. The method of claim 1 further the step of disposing an intermediate layer between the substrate and the receiving layer.

4. The method of claim 1 further comprising the step of forming a printing layer between the substrate and the receiving layer.

5. The method of claim 4 wherein the printing layer is colored to the sepia tone.

6. The method of claim 3 further comprising the steps of forming a first printing layer between the substrate and the intermediate layer and forming a second printing layer between the intermediate layer and the receiving layer.

7. The method of claim 6 wherein the printing layers are colored the sepia tone.

8. The method of claim 1 further comprising the step of forming a back coat layer on the substrate.

9. The method of claim 1 wherein the step of coloring the transfer material is further defined by coloring the transfer material with a material selected from the group consisting of: organic pigments; inorganic pigments; direct dyes; acidic dyes; basic dyes; oleosoluble dyes and dispersable dyes.

10. The method of claim 1 wherein an average tone of the transfer material has a distance 1 from an origin of not less than 10 and L* of not less than 40 assuming L*=100, a*=0, b*=0 as the origin in an L*a*b* calorimetric system.

11. A method of forming images of a sepia tone comprising the steps of:

coloring a silver salt photographic paper to a sepia tone, the silver salt photographic paper comprising a substrate and a light sensitive emulsion layer;

exposing the silver salt photographic paper; and developing the silver salt photographic paper to form a photographic image.

12. The method of claim 11 wherein the substrate is colored to the sepia tone.

13. The method of claim 11 further comprising the step of disposing an intermediate layer between the substrate and the light sensitive emulsion layer.

14. The method of claim 13 wherein the intermediate layer is colored to the sepia tone.

15. The method of claim 11 wherein the light sensitive emulsion layer is colored to the sepia tone.

16. A method of forming images of a predetermined color comprising the steps of:

providing a transfer material comprising, in sequential order, a substrate, a first printing layer, an intermediate layer, a second printing layer, and a receiving layer;

coloring the printing layers to a predetermined color; and forming images on the transfer material.

17. The method of claim 16 wherein the predetermined color is a sepia tone.

* * * * *